US009308411B2

(12) United States Patent
Friedberg et al.

(10) Patent No.: US 9,308,411 B2
(45) Date of Patent: Apr. 12, 2016

(54) EXERCISE DEVICE AND BUCKLE

(71) Applicant: SPRI PRODUCTS, INC., Libertyville, IL (US)

(72) Inventors: Drew Friedberg, Louisville, CO (US); Sean Leyden, Littleton, CO (US)

(73) Assignee: GAIAM AMERICAS, INC., Louisville, CO (US)

( * ) Notice: Subject to any disclaimer, the term of this patent is extended or adjusted under 35 U.S.C. 154(b) by 63 days.

(21) Appl. No.: 14/478,534

(22) Filed: Sep. 5, 2014

(65) Prior Publication Data

US 2016/0067538 A1 Mar. 10, 2016

(51) Int. Cl.

| | |
|---|---|
| ***A63B 21/02*** | (2006.01) |
| ***A63B 21/00*** | (2006.01) |
| ***A44B 11/00*** | (2006.01) |
| ***A44B 11/26*** | (2006.01) |
| ***A63B 21/055*** | (2006.01) |
| ***A63B 23/12*** | (2006.01) |

(52) U.S. Cl.

CPC ..... *A63B 21/00061* (2013.01); *A44B 11/005* (2013.01); *A44B 11/266* (2013.01); *A63B 21/00043* (2013.01); *A63B 21/00185* (2013.01); *A63B 21/026* (2013.01); *A63B 21/055* (2013.01); *A63B 21/1469* (2013.01); *A63B 21/1484* (2013.01); *A63B 23/12* (2013.01)

(58) Field of Classification Search

CPC ..... A63B 21/00061; A63B 21/026; A63B 21/1484; A63B 21/00185; A63B 21/1469; A63B 21/055; A63B 21/00043; A63B 23/12; A63B 21/0061; A44B 11/266; A44B 11/005; Y10T 24/45524; Y10T 24/45534; Y10T 403/4688

See application file for complete search history.

(56) References Cited

U.S. PATENT DOCUMENTS 5,505,677 A 4/1996 Hinds
5,800,322 A * 9/1998 Block ..... A63B 21/0004 482/126

(Continued)

*Primary Examiner* — Oren Ginsberg
*Assistant Examiner* — Megan Anderson
(74) *Attorney, Agent, or Firm* — Barnes & Thornburg LLP

(57) ABSTRACT

An exercise device comprising a handle having two ends, a buckle comprising a receptacle secured to the handle and a clamp secured to the other end of the handle, and an elongate flexible tube. The receptacle and clamp selectively releasably engageable together to join the two ends of the handle and disengageable to separate the two ends of the handle. The receptacle and clamp defining a hole when the receptacle and clamp are releasably engaged. The hole having an outer dimension. The elongate flexible tube sized to be received by the hole and having an enlarged portion. The enlarged portion having a clearance dimension greater than the outer dimension of the hole to prevent the elongate flexible tube from disengaging from the buckle.

12 Claims, 3 Drawing Sheets

(56) References Cited

U.S. PATENT DOCUMENTS

| | | | | |
|---|---|---|---|---|
| 6,497,641 | B1 | 12/2002 | Hinds | |
| 6,923,750 | B1 * | 8/2005 | Hinds | A63B 21/00043 482/121 |
| 7,147,592 | B2 | 12/2006 | Hinds et al. | |
| 7,175,574 | B2 | 2/2007 | Carmel et al. | |
| 7,316,636 | B1 | 1/2008 | Hinds et al. | |
| 7,455,632 | B2 | 11/2008 | Block et al. | |
| 7,503,883 | B2 | 3/2009 | Madden | |
| 7,625,324 | B1 | 12/2009 | Hinds et al. | |
| 7,628,743 | B1 | 12/2009 | Flentye et al. | |
| 8,075,462 | B1 | 12/2011 | Hinds et al. | |
| 8,152,703 | B1 | 4/2012 | Hinds et al. | |
| 8,348,814 | B1 | 1/2013 | Hinds et al. | |
| 8,480,549 | B1 | 7/2013 | Hinds et al. | |
| 8,876,678 | B2 | 11/2014 | Flentye et al. | |
| 8,961,379 | B2 * | 2/2015 | Flentye | A63B 21/0552 482/121 |
| 9,050,484 | B2 * | 6/2015 | Flentye | A63B 21/1465 |
| 2009/0176634 | A1 * | 7/2009 | Wu | A63B 21/0004 482/122 |
| 2009/0178252 | A1 * | 7/2009 | Yang | A44B 11/266 24/625 |
| 2015/0366298 | A1 * | 12/2015 | Blackman | A44B 11/005 431/253 |

* cited by examiner

EXERCISE DEVICE AND BUCKLE

The present disclosure relates generally to an exercise device and a buckle.

BACKGROUND

Resistance exercise devices comprising a stretchable elongate flexible tube and a pair of handles are known. An example of a resistance exercise device including an elongate flexible and stretchable tube is disclosed, for example, in U.S. Pat. No. 5,800,322. Such exercise devices typically are available with flexible and stretchable elongate tubes of different resistance levels to provide exercise enthusiasts with training alternatives.

SUMMARY

The present disclosure is directed to an exercise device comprising at least one handle having two ends; a buckle comprising a receptacle secured adjacent one end of the handle and a clamp secured adjacent the other end of the handle; and an elongate flexible tube. The receptacle and clamp are selectively releasably engageable together to join the two ends of the handle and disengageable to separate the two ends of the handle. The receptacle and clamp define a hole when the receptacle and clamp are releasably engaged, the hole having an outer dimension. The elongate flexible tube is sized to be received by the hole, as the receptacle and clamp are releasably engaged. The elongate flexible tube has an enlarged portion having a clearance dimension greater than the outer dimension of the hole. The elongate flexible tube is received by the hole and is engaged with the handle. The enlarged portion of the elongate flexible tube prevents the elongate flexible tube from disengaging from the buckle when the receptacle and clamp are releasably engaged. The handle may be in the form of a strip of material. An illustrated embodiment of the exercise device of the present disclosure includes another handle releasably secured to another enlarged portion of the elongate flexible tube.

The receptacle may include an inner wall including a pair of opposed wall segments defining a slot and an arcuate wall segment interconnecting the pair of inner wall segments defining a bore contiguous with the slot. The clamp may include a prong received by the slot, the arcuate wall segment of the receptacle and an arcuate end of the prong defining the hole when the receptacle and the clamp are releasably engaged. The clamp may include a pair of spaced flexible locking legs and the receptacle may define a pair of spaced channels for receiving the flexible locking legs when the receptacle and the clamp are releasably engaged. The receptacle may define a pair of cut out portions, each cut out portion contiguous with a respective channel. The cut out portions facilitate squeezing together of the flexible locking legs for separating the flexible locking legs from the receptacle to disengage the receptacle and clamp. The flexible locking legs may include bosses received by the cut out portions and a catch for engaging the receptacle when the receptacle and clamp are releasably engaged. The present disclosure is also directed to the buckle.

Features and advantages of the disclosure will be set forth in part in the description which follows and the accompanying drawings described below, wherein embodiments of the disclosure is described and shown, and in part will become apparent upon examination of the following detailed description taken in conjunction with the accompanying drawings.

BRIEF DESCRIPTION OF THE DRAWINGS

Other aspects and advantages of the present disclosure will become apparent upon consideration of the following detailed description, wherein similar structures have like or similar reference numerals.

DETAILED DESCRIPTION

Figure 1:
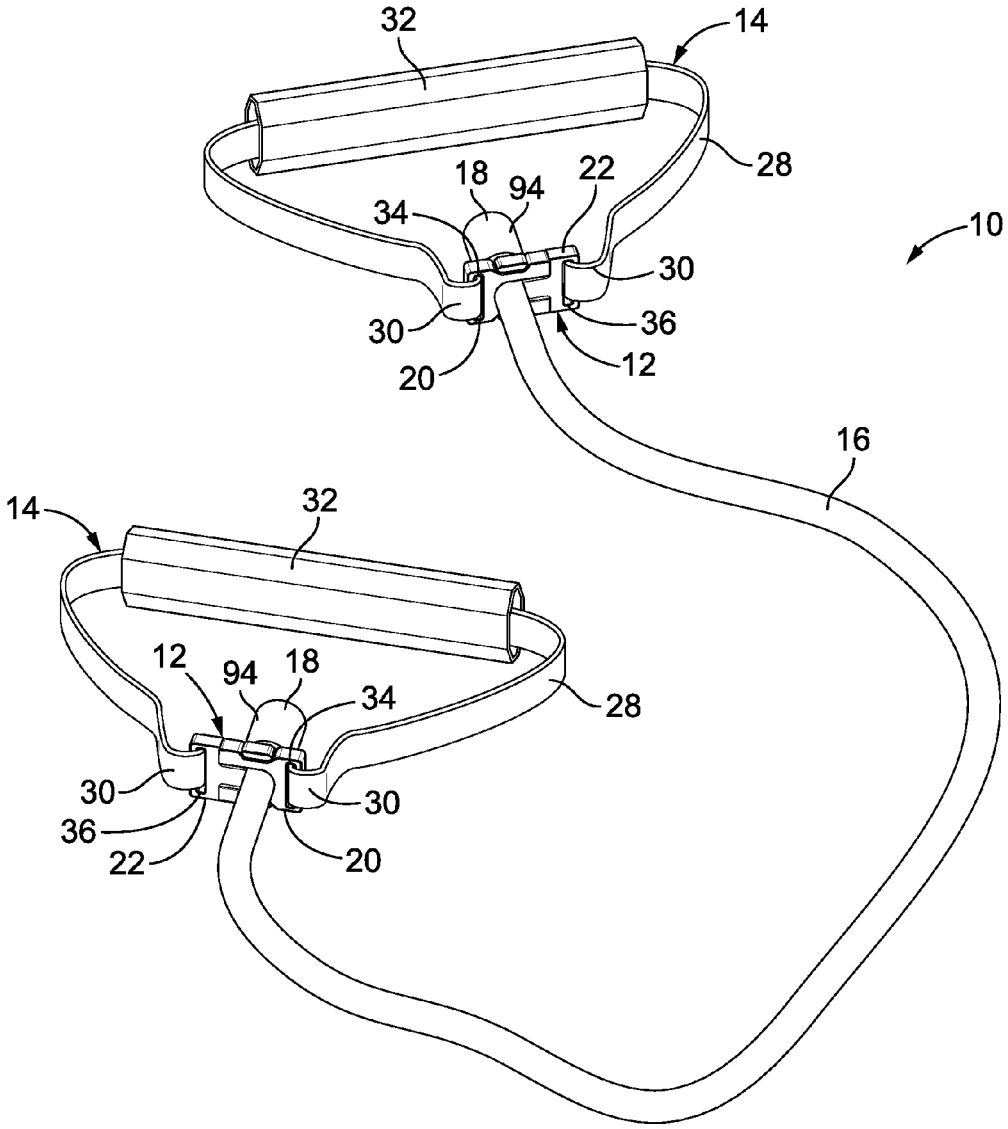
FIG. 1 is a perspective view of the exercise device in accordance with an illustrated embodiment of the present disclosure, illustrating buckles of the exercise device in closed positions releasably securing an elongate flexible tube to handles of the exercise device.

While the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

FIGS. 1-5 illustrate an exercise device 10 in accordance with an embodiment of the present disclosure. The exercise device 10 comprises a pair of buckles 12, a pair of handles 14 and an elongate flexible and stretchable tube 16 that is releasably secured to the handles 14 by the buckles 12 as described in detail below. The handle has a pair of ends 18.

Each buckle 12 comprises a receptacle 20 secured to or otherwise adjacent one of the ends 18 of one of the handles 14 and a clamp 22 secured to or otherwise adjacent the other end 18 of the handle 14. The receptacle 20 and clamp 22 of each handle 14 are selectively releasably engageable with each other to secure the elongate flexible tube 16 to the handle and disengageable from each other to unsecure the elongate flexible tube from the handle.

Each of the illustrated handles 14 comprises a webbing or the like in the form of a strip material 28 having two ends 30 and a gripping sheath 32 disposed about a portion of the strip 28. In accordance with other embodiments, the handle 14 may comprise a pair of strips of material, each connected to the receptacle 20 or clamp 22 at or otherwise adjacent its end. The handle 14 may have any other suitable structure and comprise any other suitable material in accordance with other embodiments of the present disclosure.

In the illustrated embodiment, each of the receptacle 20 and clamp 22 defines a slit 34, 36 for receiving the strip 28 which is looped back and then stitched together to engage the respective receptacle 20 or clamp 22. Each end of the strip 28 is secured to the handle 14 at or otherwise adjacent to the respective end 30 of the strip. The strip 28 can be secured to the receptacle 20 or clamp 22 in any other suitable manner in accordance with other embodiments of the present disclosure.

The illustrated receptacle 20 includes a base member 38 defining the slit 34 and a pair of spaced arms 44 extending from the base member 38 in a direction opposite the slit 34. The arms 44 are hollow and define channels 46 for engaging the clamp 22 as hereinafter described. Each of the arms 44 also includes a cut out portion 50 formed by edges 58*a-e*.

Each of the cut out portions 50 is contiguous with a respective channel 46. The receptacle 20 includes an inner wall 52 that includes a pair of opposed inner wall segments 54 and a semi-circular or otherwise arcuate wall segment 56 interconnecting the inner wall segments 54. The inner wall segments 54 and arcuate wall segment 56 define a slot 60 along a portion of the length of the receptacle 20 between the arms 44 and a bore 62 contiguous with the slot. The receptacle 20 may be constructed of plastic or any other suitable material. The receptacle 20 may have any other construction and configuration in accordance with other embodiments of the present disclosure.

The clamp 22 includes a base member 68, a prong 70 extending from the base member 38 in a direction opposite the slit 36 receivable by the slot 60 of the receptacle 20, and a pair of spaced flexible locking legs 72 receivable by the channels 46 defined by the arms 44 of the receptacle 20. The prong 70 is disposed between the flexible locking legs 72 and has a shorter length than the flexible locking legs. The prong 70 terminates in an arcuate wall 80. Each of the flexible locking legs 72 terminates in an inner chamfered surface 82 and an outer chamfered surface 84 to facilitate receipt of the flexible locking legs into the channels 46 of the receptacle 20. Each of the flexible locking legs 72 includes a boss 86 on its outer wall that includes a catch 90. The clamp 22 may be constructed of plastic or any other suitable material. The clamp 22 may have any other construction and configuration in accordance with other embodiments of the present disclosure.

The elongate flexible tube 16 has enlarged portions 94 at or otherwise adjacent each of its ends 18. The elongate flexible tube 16 may be hollow and may define a channel along its length. The enlarged portions 94 may be formed or constructed in any suitable manner. For example, plugs or the like (not shown) may be received within the channel and positioned adjacent the respective open ends of the elongate flexible tube 16 to form the enlarged portions 94. The plugs, for example, may have generally cylindrical configurations or any other suitable configuration. The enlarged portions 94 each have an outer diameter, outer width or other clearance dimension that is greater than the outer diameter, outer width or other clearance dimension of the elongate flexible tube 16 extending substantially along the length of the elongate flexible tube 16. The enlarged portions 94 may be constructed or configured in any other suitable manner in accordance with other embodiments of the present disclosure.

The elongate flexible tube 16 and plugs may be constructed of any suitable material, such as rubber or the like, or may have any other suitable structure and configuration. The plug may be substantially thicker than the elongate flexible tube 16 to provide increased rigidity. The elongate flexible tube 16 may be in the form of any other structure or material in accordance with other embodiments of the present disclosure. The elongate flexible tube 16, alternatively, may be in the form of any other suitable cord in accordance with other embodiments of the present disclosure. Additionally, the one or more enlarged portions may instead be in the form of any suitable structure secured to the elongate flexible tube 16 or other cord.

To releasably engage the receptacle 20 and clamp 22, the elongate flexible tube 16 or other cord is inserted into the slot 60 of the receptacle. The flexible locking legs 72 of the clamp 22 are then inserted into the channels 46 of the arms 44 of the receptacle 20 and slid along the length of the channels. During the sliding, the inner and outer chamfered surfaces 82 and 84 of the flexible locking legs 72 facilitate sliding into the channels 46 and inward flexing of the flexible locking legs. As the flexible locking legs 72 slide in the channels 46, the prong 70 of the clamp 22 also slides into the slot 60 of the receptacle 20. When the bosses 86 of the flexible locking legs 72 slide into the cut out portions 50 of the receptacle 20, the catches 90 of the flexible locking legs 72 engage the edges 58*a* of the receptacle 20 or other structure of the receptacle in accordance with other embodiments to releasably lock the clamp 22 to the receptacle 20. As the locking occurs, the flexible locking legs 72 may flex outward and the bosses 86 are disposed in the cutout portions 50. When the receptacle 20 and the clamp 22 are releasably engaged, the arcuate wall segment 80 of the prong 70 enclose the bore 62, and the arcuate wall segment 56 of the receptacle 20 and the arcuate wall 80 of the prong 70 define a hole 98 receiving the elongate flexible tube 16 or other cord. The hole 98 has a diameter or other outer dimension 100. The clearance dimension 96 of the enlarged portion 94 is greater than the outer dimension 100 of the hole 98 of the buckle 12.

To disengage the clamp 22 from the receptacle 20, the bosses 86 may be pressed or squeezed toward each other to flex inwardly the flexible locking legs 72 and unlock the catch 90 from the receptacle, and the clamp 22 is pulled relative to the receptacle until the clamp 22 is separated from the receptacle. The cut out portions 50 of the receptacle 20 provide easy access to the bosses 86 of the flexible locking legs 72 to facilitate squeezing of the flexible locking legs.

Figure 2:
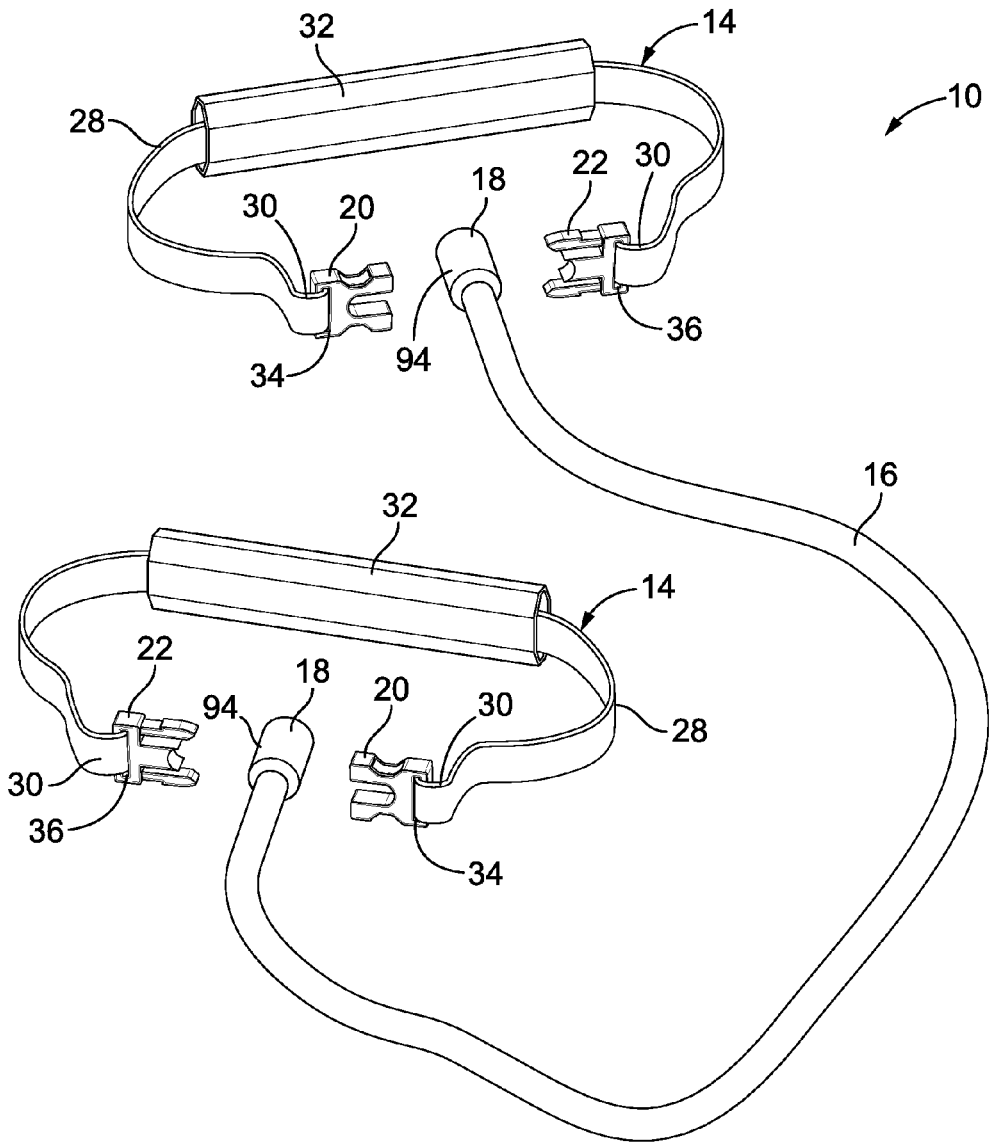
FIG. 2 is a perspective view of the exercise device of FIG. 1, illustrating the buckles in open positions.
Figure 3:
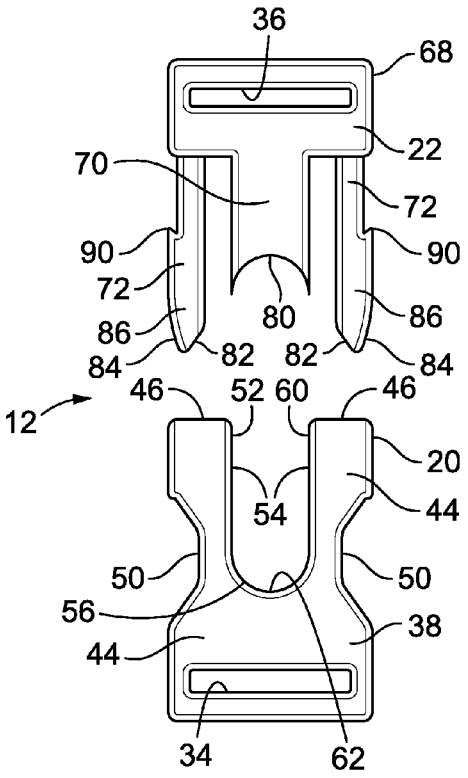
FIG. 3 is a plan view of a buckle in accordance with an illustrated embodiment of the present disclosure in a disengaged position.
Figure 4:
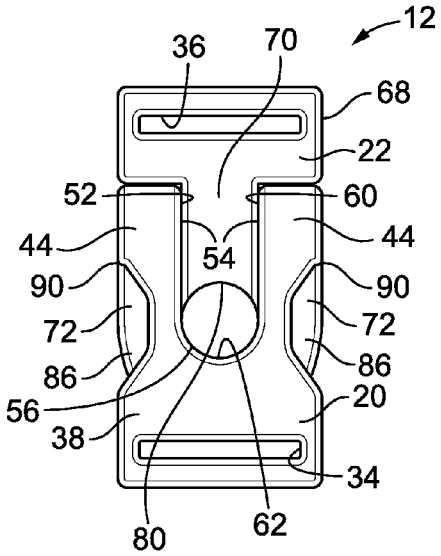
FIG. 4 is a plan view of the buckle of FIG. 3 in an engaged position.
Figure 5:
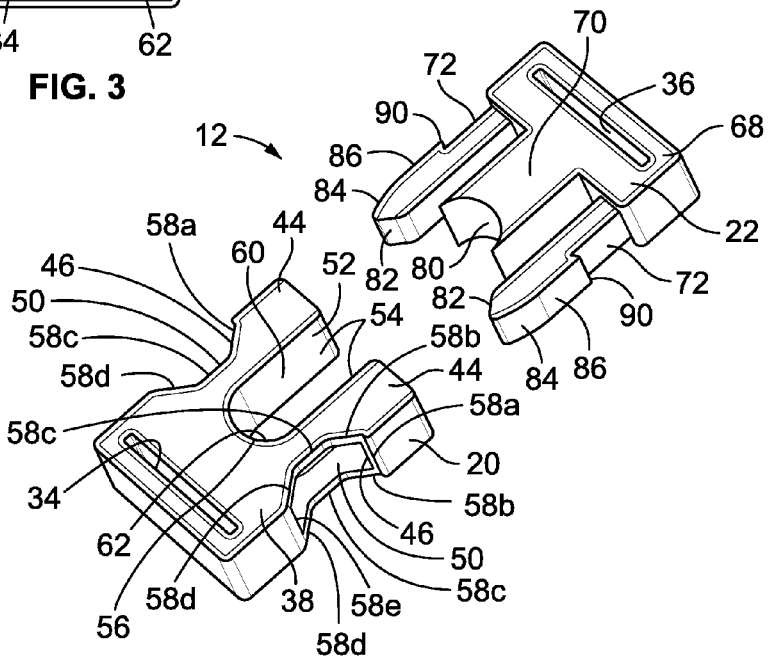
FIG. 5 is a perspective view of the buckle of FIG. 3 in a disengaged position.

In the embodiment illustrated in FIGS. 1 and 2, to engage the flexible tube 16 to one of the handles 14, the receptacle 20 and clamp 22 of one of the buckles 12 of the handle are separated. A user slides the elongate flexible tube 16 into the slot 60 and bore 62 of the receptacle 20 with the enlarged portion 94 of the elongate flexible tube 16 being positioned such that it will be in the loop formed by the handle 14 and buckle 12 when the receptacle 20 and clamp 22 are releasably engaged. The clamp 22 is then releasably engaged with the receptacle 20 as set forth above to secure the elongate flexible tube 16 to the buckle 12 and, thus, to the handle 14. The enlarged portion of the elongate flexible tube 16 prevents the elongate flexible tube 16 from disengaging from the buckle 12. The other end of the elongate flexible tube 16 is secured to the other handle 14 in a similar manner. One or both of the handles 14 may be disengaged from the elongate flexible tube 16 by disengaging the receptacle 20 and clamp 22 as described above.

The present disclosure provides many benefits. For example, it facilitates ready engagement of the elongate flexible tube 16 to the handles 14 and ready disengagement. It also facilitates interchangeability of the elongate flexible tube 16 of the exercise device 10 so that that elongate flexible tubes can readily be replaced with other elongate flexible tubes having different resistance levels. Additionally, the buckle 12 may be used in any other suitable in connection with any suitable exercise device 10 or any other suitable device or structure in accordance with other embodiments of the present disclosure.

Numerous modifications to the present disclosure will be apparent to those skilled in the art in view of the foregoing description. Accordingly, this description is to be construed as illustrative only and is presented for the purpose of enabling those skilled in the art to make and use the embodiments of the disclosure and to teach the best mode of carrying out same. The exclusive rights to all modifications which come within the scope of the appended claims are reserved.

The invention claimed is:

1. An exercise device comprising:

(a) a handle having two ends;

(b) a buckle comprising a receptacle secured adjacent one end of the handle and a clamp secured adjacent the other end of the handle, the receptacle and clamp selectively releasably engageable together to join the two ends of the handle and disengageable to separate the two ends of the handle, the receptacle and clamp defining a hole when the receptacle and clamp are releasably engaged, the hole having an outer dimension; and (c) an elongate flexible tube sized to be received by the hole and having an enlarged portion, the enlarged portion having a clearance dimension greater than the outer dimension of the hole;

whereby when the elongate flexible tube is received by the hole and the receptacle and clamp are releasably engaged, the elongate flexible tube is engaged with the handle and the enlarged portion prevents the elongate flexible tube from disengaging from the buckle.

2. The exercise device of claim 1 wherein the clamp includes a pair of spaced flexible locking legs and the receptacle defines a pair of spaced channels for receiving the flexible locking legs when the receptacle and the clamp are releasably engaged.

3. The exercise device of claim 2 wherein the receptacle defines a pair of cut out portions, each cut out portion contiguous with a respective channel, the cut out portions to facilitate squeezing together of the flexible locking legs for separating the flexible locking legs from the receptacle for disengaging the receptacle and clamp.

4. The exercise device of claim 2 wherein at least one of the flexible locking legs includes a catch for engaging the receptacle when the receptacle and clamp are releasably engaged.

5. The exercise device of claim 2 wherein each of the flexible locking legs includes a catch for engaging the receptacle when the receptacle and clamp are releasably engaged.

6. The exercise device of claim 2 wherein at least one of the flexible locking legs includes a catch for engaging the receptacle when the receptacle and clamp are releasably engaged and the receptacle includes structure for engaging the catch when the receptacle and clamp are releasably engaged.

7. The exercise device of claim 2 wherein each of the flexible locking legs includes a catch for engaging the receptacle when the receptacle and clamp are engaged and the receptacle includes a pair of structures, each structure for engaging a respective catch when the receptacle and clamp are releasably engaged.

8. The exercise device of claim 1 wherein the receptacle includes an inner wall including a pair of opposed wall segments defining a slot and an arcuate wall segment interconnecting the pair of inner wall segments defining a bore contiguous with the slot, and wherein the clamp includes a prong received by the slot, the arcuate wall segment of the receptacle and an end of the prong defining the hole when the receptacle and the clamp are releasably engaged.

9. The exercise device of claim 2 wherein the end of the prong comprises an arcuate wall facing the arcuate wall segment of the receptacle when the receptacle and the clamp are releasably engaged.

10. The exercise device of claim 1 wherein the receptacle defines a slit for receiving the handle to secure the handle to the receptacle and the clamp defines a slit for receiving the handle to secure the handle to the clamp.

11. The exercise device of claim 1 wherein the handle comprises a strip, the receptacle defines a slit for receiving the strip to secure the handle to the receptacle and the clamp defines a slit for receiving the strip to secure the handle to the clamp.

12. The exercise device of claim 1 further comprising:

(a) another handle having two ends; and (b) another buckle comprising a receptacle secured adjacent one end of the other handle and a clamp secured adjacent the other end of the other handle, the receptacle and clamp of the other buckle selectively engageable together to join the two ends of the other handle and disengageable to separate the two ends of the other handle, the receptacle and clamp of the other buckle defining a hole when the receptacle and clamp of the other buckle are releasably engaged, the hole of the other buckle having a clearance dimension; and wherein the elongate flexible tube includes another enlarged portion, the elongate flexible tube sized to be received by the hole of the other buckle, the other enlarged portion having a clearance dimension greater than the clearance dimension of the hole of the other buckle;

whereby when the elongate flexible tube is received by the hole of the other buckle and the receptacle and clamp of the other buckle are releasably engaged, the elongate flexible tube is engaged with the other handle and the other enlarged portion prevents the elongate flexible tube from disengaging from the other buckle.

* * * * *